United States Patent [19]

Clark

[11] 4,230,506

[45] Oct. 28, 1980

[54] CAM SHAFT MANUFACTURING PROCESS

[75] Inventor: Robert L. Clark, North Muskegon, Mich.

[73] Assignee: Textron, Inc., Providence, R.I.

[21] Appl. No.: 45,752

[22] Filed: Jun. 5, 1979

[51] Int. Cl.[3] ..... C22C 37/00; C21D 9/30

[52] U.S. Cl. ..... 148/3; 148/35; 148/39; 148/125

[58] Field of Search ..... 148/35, 39, 3, 152, 148/125, 138, 144, 142, 141; 75/123 CB

[56] References Cited

U.S. PATENT DOCUMENTS

| | | | |
|---|---|---|---|
| 3,005,736 | 10/1961 | Peras | 75/123 CB |
| 3,370,941 | 2/1968 | Kueny | 148/35 |
| 3,384,515 | 5/1968 | Ackerman et al. | 148/35 |
| 3,690,957 | 9/1972 | Thompson | 148/35 |
| 4,032,334 | 6/1977 | Burk et al. | 148/39 |
| 4,043,847 | 8/1977 | Just | 148/39 |
| 4,124,413 | 11/1978 | Komatsu et al. | 148/35 |

*Primary Examiner*—L. Dewayne Rutledge
*Assistant Examiner*—Peter K. Skiff
*Attorney, Agent, or Firm*—John E. McGarry

[57] ABSTRACT

A cam shaft manufacturing process wherein a cam shaft is cast from a heat-treatable gray cast iron having a high carbide microstructure, is annealed while retaining the carbides and then cooled to room temperature. Surfaces, such as cam lobe surfaces, are then surface hardened and the cam shaft may thereafter be machined. The heat treating process comprises heating the cam shaft at 1600° F. (871° C.) in about twenty minutes, holding the cam shaft at 1600° F. (871° C.) for about twenty minutes and thereafter heat treating the cam shafts at a temperature of 1600° to 1640° F. (871° to 893° C.) for about eighty minutes. The cam shafts are then cooled rapidly to about 400° F. (204° C.), for example, within about an hour and a half, and thereafter air cooled.

14 Claims, No Drawings

CAM SHAFT MANUFACTURING PROCESS

TECHNICAL FIELD OF THE INVENTION

This invention relates to the manufacture of cam shafts having a series of cam lobes wherein the cam shafts are cast from a heat-treatable gray iron having a high alloy content.

BACKGROUND ART

In the manufacture of cam shafts for internal combustion engines, the cam shafts have been made by casting, or by steel forgings or by machining steel bar stock. The cam shafts have a very complex shape. Forging is a difficult process for making complex shapes to close tolerances. Accordingly, the forged cam shafts require some machining. Both of the forging and machining processes are quite expensive and difficult.

Recently, a cam shaft has been made by casting a heat-treatable gray cast iron with the following composition:

| Analysis | Preferred Range Percent | General Range Percent |
|---|---|---|
| Carbon | 3.25–3.45 | 3.00–3.60 |
| Silicon | 2.25–2.45 | 1.75–2.60 |
| Manganese | 0.60–0.90 | .50–.90 |
| Chromium | 1.30–1.50 | 1.30–1.70 |
| Nickel plus copper | 0.40–0.60 | .40–.80 |
| Molybdenum | 0.40–0.50 | .30–.75 |
| Sulfur | 0.15–max | .15 |
| Phosphorus | 0.15–max | .15 |
| Vanadium | 0.25–0.40 | .25–.60 |

This alloy in as-cast condition has significant carbides and a high hardness, pearlitic matrix. It is necessary to machine these castings somewhat to maintain tolerances. Thus, the castings must be annealed prior to machining. The as-cast hardness of the cam shaft was in the range of 331–364 Brinell. These cam shafts were heat treated by raising the temperature to 1420° F. (771° C.) in four and one-half hours, holding that temperature for four to four and a half hours and then cooling slowly to atmospheric temperature in the oven. The cooling process typically took in excess of six or seven hours.

Although the annealing decreased the Brinell hardness while retaining the carbides, it was found that the machinability was highly irregular and generally unsatisfactory. Some cam shafts thus heat-treated were virtually unmachinable.

SUMMARY OF THE INVENTION

According to the invention, a process for manufacturing a cam shaft having series of cam lobes from a heat-treatable gray cast iron comprises casting the cam shaft from a gray iron composition which includes elements selected from the group consisting of silicon, manganese, chromium, nickel, copper, molybdenum and vanadium, annealing the cast cam shaft to lower the hardness while retaining carbides, cooling the cam shaft, milling, surface hardening the cam lobe and thereafter machining the cam shaft. The improvement in applicant's invention comprises the heat-treating step in which the cam shaft is heated to a temperature in the range of 1550° to 1700° F. (843°–927° C.) in a relatively short period of time, for example, less than two hours, holding the cam shaft at the temperature for a relatively short period of time, for example, 1–4 hours, to enable the hardness to be reduced while retaining most of the carbides and thereafter cooling the cam shaft relatively quickly, for example, within about four hours. Preferably, the cam shaft is heated to about 1600° F. (871° C.) and held at that temperature for about thirty minutes, thereafter heated to a temperature within the range of 1600° to 1640° F. (871°–893° C.) for a period of eighty minutes, and then furnace cooled to a temperature of 400° F. (204° C.) in about one and one half hours.

DESCRIPTION OF THE PREFERRED EMBODIMENT

The heat-treatable gray cast iron is generally a cast iron with a relatively high percentage of carbon and carbide-forming elements including chromium, molybdenum and vanadium. A graphitizing agent such as silicon and a sulfur scavenger such as manganese are desirably present in the composition. Pearlite stabilizers in the form of nickel and chromium are also added to the composition. A gray cast iron according to the invention has the following alloys:

| Element | Range - Percent |
|---|---|
| Total carbon | 3.25–3.45 |
| Silicon | 2.25–2.45 |
| Manganese | 0.60–0.90 |
| Chromium | 1.30–1.50 |
| Nickel plus copper | 0.40–0.60 |
| Molybdenum | 0.40–0.50 |
| Sulfur | 0.15–max |
| Phosphorus | 0.15–max |
| Vanadium | 0.25–0.40 |

The Brinell hardness of the cam shaft as cast can vary but typically is in the range of 310 to 365 brinell. Subsequent to annealing the cam shaft hardness is reduced to approximately 270 to 320 Brinell.

The temperature to which the cam shafts are heated is higher than normal annealing temperatures and is in the range of 1500° to 1700° F. (843° to 927° C.). The cam shafts are brought up to this temperature rapidly, for example, within 20 minutes to 1 hour, preferably within about 20 minutes. In a preferred embodiment, the cam shafts are brought up to a temperature of 1550° to 1600° F. (843° to 871° C.) in about 20 minutes. The cam shafts are thereafter held at this temperature to avoid thermal shock for a period of about 20 to 30 minutes and are thereafter subjected to an annealing temperature between 1550° and 1700° F. (843°–927° C.), preferably between 1600° and 1640° F. (871°–893° C.) for a time of about one to four hours, preferably about 80 minutes. The time at which the cam shafts are held at the annealing temperature is selected so as to break down some of the iron carbides but retain the chromium carbides and/or iron-chromium carbides and to maintain the interstitial effect of vanadium carbide.

The cooling from the annealing temperature takes place relatively rapidly, though not at quench rates, and to avoid thermal shock. The cooling takes place within one to four hours generally and preferably in about an hour and a half to about 400° F. (204° C.).

The heat treating process, including cooling to 400° F. (204° C.) takes place in the lobes and other portions of the cam shafts can be surface hardened such as flame or induction hardening in a conventional manner. The cam shafts are typically straightened, if necessary, ground and drilled prior to the flame-hardening process. Subsequent to flame hardening, the cam shafts can be quenched to −20° F. (−29° C.) to transform any retained austenite into martensite.

The cam shafts made according to the invention have been found to be particularly suitable for diesel engines.

SPECIFIC EXAMPLE

A cam shaft was cast from a heat-treatable gray cast iron having the following composition:

| Element | Analysis |
|---|---|
| Carbon | 3.35 |
| Silicon | 2.35 |
| Manganese | .70 |
| Chromium | 1.40 |
| Nickel plus copper | .50 |
| Molybdenum | .50 |
| Sulfur | .13 |
| Phosphorus | .06 |
| Vanadium | .30 |

The cam shaft had an as-cast brinell hardness in the range of 331 to 364. The cam shaft was heated to 1600° F. (871° C.) in 20 minutes in an electric furnace. The furnace temperature was then raised to 1640° F. (893° C.) and held at that temperature for 80 minutes. Subsequently, the temperature in the furnace was cooled to 400° F. (204° C.) in one and a half hours. The cam shaft was then taken out of the furnace and allowed to air cool. The hardness of the cam shaft thus heat treated was in the range of 311 to 321 BHN.

Subsequent to the heat treatment, the ends of the cam shaft were ground and drilled and the lobes of the cam shaft were flame hardened. Subsequent to the flame-hardening procedure, the cam shaft was quenched at a temperature of −20° F. (−29° C.) in a freezer until the cam shaft reaches this temperature.

The cam shaft was then found to have good machinability in other areas other than the surface treated cam lobes.

Reasonable variation and modification are possible within the scope of the foregoing disclosure and drawings without departing from the spirit of the invention.

The embodiments of the invention in which an exclusive property or privilege is claimed are defined as follows:

1. In a process for manufacturing a cam shaft having a series of cam lobes wherein the cam shaft is cast from a heat-treatable gray cast iron having alloyed therewith elements selected from the group consisting of silicon, manganese, chromium, nickel, copper, molybdenum and vanadium, wherein the cast cam shaft is heat treated to improve the machinability while maintaining carbide structure, and is thereafter milled, surface hardened at least at the cam lobes and thereafter machined, the improvement in the heat-treating step comprising:

heating said cam shaft to a temperature in the range of about 1550° to 1700° F. (843°-927° C.) in a time less than two hours, holding said cam shaft at said temperature for a period of one to four hours to anneal the cam shaft while retaining carbides and without substantial formation of austenite, and cooling said cam shaft to at least 400° F. (204° C.) within one to four hours.

2. A process for manufacturing a cam shaft according to claim 1 wherein the heating step comprises heating the cam shaft to said temperature in about 20 minutes.

3. A process for manufacturing a cam shaft according to claim 1 wherein the heating step comprises heating the cam shaft to a temperature of about 1600° F. (871° C.) in about 20 minutes.

4. A process for manufacturing a cam shaft according to claim 3 wherein the heating step further includes the step of heating the cam shaft to a higher temperature in the temperature range after the cam shaft has been held at 1600° F. (871° C.) for a short period of time.

5. A process for manufacturing a cam shaft according to claim 4 wherein the short period of time is 20 to 60 minutes.

6. A process for manufacturing a cam shaft according to claim 5 wherein the higher temperature is in the range of 1600° to 1640° F. (871°-893° C.).

7. A process for manufacturing a cam shaft according to claim 6 wherein the cam shaft is held at the higher temperature for a time of one to four hours.

8. A process for manufacturing a cam shaft according to claim 6 wherein the cooling step includes cooling the cam shaft to 400° F. (204° C.).

9. A process for manufacturing a cam shaft according to claim 1 wherein the cooling step comprises cooling the cam shaft to 400° F. (204° C.).

10. A process for manufacturing a cam shaft according to claim 9 wherein the cast iron has a composition as follows:

| Element | Range - Percent |
|---|---|
| Carbon | 3.25-3.45 |
| Silicon | 2.25-2.45 |
| Manganese | 0.60-0.90 |
| Chromium | 1.30-1.50 |
| Nickel plus copper | 0.40-0.60 |
| Molybdenum | 0.40-0.50 |
| Sulfur | 0.15-max |
| Phosphorus | 0.15-max |
| Vanadium | 0.25-0.40 |

11. A process for manufacturing a cam shaft according to claim 1 wherein the cooling step is carried out within 1½ hours.

12. A process for manufacturing a cam shaft according to claim 11 and further comprising the step of cooling the cam shaft to a temperature of −20° F. (−29° C.) subsequent to the surface-hardening step in order to eliminate retained austenite.

13. A process for manufacturing a cam shaft according to claim 1 wherein the heating step comprising heating the cam shaft to about 1600° F. (871° C.) in about 20 minutes;

the temperature holding step comprises holding the cam shaft at a temperature of about 1600° F. (871° C.) for 20 minutes and thereafter heat treating the cam shaft at a temperature in the range of 1600° to 1640° F. (871°-893° C.) for a period of about 80 minutes; and said cooling step comprises cooling said cam shaft to 400° F. (204° C.) in about one and a half hours.

14. A process for manufacturing a cam shaft according to claim 13 wherein the cast iron has a composition as follows:

| Element | Range - Percent |
|---|---|
| Carbon | 3.25-3.45 |
| Silicon | 2.25-2.40 |
| Manganese | 0.60-0.90 |
| Chromium | 1.30-1.50 |
| Nickel plus copper | 0.40-0.60 |
| Molybdenum | 0.40-0.50 |
| Sulfur | 0.15-max |
| Phosphorus | 0.15-max |
| Vanadium | 0.25-0.40 |

* * * * *